US009863609B2

(12) United States Patent
De Vaan et al.

(10) Patent No.: US 9,863,609 B2
(45) Date of Patent: Jan. 9, 2018

(54) ADJUSTABLE ILLUMINATION DEVICE PROVIDING POLARIZED LIGHT HAVING AN INDICATION MEANS FOR PROVIDING ADJUSTMENT

(71) Applicant: PHILIPS LIGHTING HOLDING B.V., Eindhoven (NL)

(72) Inventors: Adrianus Johannes Stephanus Maria De Vaan, 'S-Hertogenbosch (NL); Marco Haverlag, Mierlo (NL); Bianca Maria Irma Van Der Zande, Heeze (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/889,452

(22) PCT Filed: May 7, 2014

(86) PCT No.: PCT/EP2014/059289
§ 371 (c)(1),
(2) Date: Nov. 6, 2015

(87) PCT Pub. No.: WO2014/180876
PCT Pub. Date: Nov. 13, 2014

(65) Prior Publication Data

US 2016/0097515 A1 Apr. 7, 2016

(30) Foreign Application Priority Data

May 7, 2013 (EP) ..... 13166755

(51) Int. Cl.
*F21V 14/08* (2006.01)
*F21S 6/00* (2006.01)
*F21V 9/14* (2006.01)

(52) U.S. Cl.
CPC ..... *F21V 14/08* (2013.01); *F21S 6/006* (2013.01); *F21V 9/14* (2013.01)

(58) Field of Classification Search
CPC ..... F21V 9/14; F21V 14/08; F21S 6/008
See application file for complete search history.

(56) References Cited

U.S. PATENT DOCUMENTS 2,402,176 A 6/1946 Marks
3,566,099 A 2/1971 Makas
(Continued)

FOREIGN PATENT DOCUMENTS

CN 87205196 U 8/1988
CN 102588895 A 7/2012
(Continued)

OTHER PUBLICATIONS

Japuntich, D.A., "Polarized task lighting to reduce reflective glare in open-plan office cubicles," Applied Ergonomics 32 (2001) 485-499 (15 pages).
(Continued)

*Primary Examiner* — Robert May

(57) ABSTRACT

An illumination device (100) for illuminating an at least partially reflective surface (S) viewable by an observer (O) is disclosed. The illumination device (100) comprises a light-emitting module (110, 120) adapted to generate polarized light having a selected direction of polarization. Further, the illumination device (100) is adapted to illuminate the at least partially reflective surface (S) with the polarized light, and is adjustable so as to effect adjustment in the direction of polarization of light illuminating the at least partially reflective surface (S) in relation to the orientation of a plane of incidence of light incident on the at least partially reflective surface. An indicator (130) is arranged such as to provide guidance for the observer (O) how to adjust the direction of polarization of light illuminating the at least
(Continued)

partially reflective surface (S). Thereby, the extent of light reflection from the at least partially reflective surface (S) may be adjusted. A luminaire comprising such an illumination device (100) and a method for facilitating for the observer to adjust the extent of light reflection from the at least partially reflective surface (S) is also disclosed.

13 Claims, 4 Drawing Sheets

(56) References Cited

U.S. PATENT DOCUMENTS

| | | | | |
|---|---|---|---|---|
| 5,161,879 | A | 11/1992 | McDermott | |
| 6,685,341 | B2 * | 2/2004 | Ouderkirk | G02B 5/3033 359/485.07 |
| 7,070,308 | B2 * | 7/2006 | Shikano | F21V 9/14 359/485.02 |
| 7,587,117 | B2 | 9/2009 | Winston et al. | |
| 2002/0089747 | A1 * | 7/2002 | Hay | G02B 7/003 359/488.01 |
| 2002/0113560 | A1 | 8/2002 | Edwards et al. | |
| 2003/0103261 | A1 * | 6/2003 | Hay | G02B 7/003 359/352 |
| 2009/0103310 | A1 | 4/2009 | Chen | |
| 2010/0294913 | A1 | 11/2010 | Roberts | |
| 2012/0230019 | A1 | 9/2012 | Peifer | |

FOREIGN PATENT DOCUMENTS

| | | | |
|---|---|---|---|
| EP | 0606939 | A1 | 7/1994 |
| EP | 0606940 | A2 | 7/1994 |
| KR | 201206657 | U | 9/2012 |

OTHER PUBLICATIONS

Clear, Robert, et al., "Multilayer Polarizers: A Review of the Claims," JIES, vol. 25, No. 2, 1995 (23 pages).

Elton, Nick J., et al., "Polarized light reflectometry for studies of paper coating structure Part II. Application to coating structure, gloss and porosity," Peer-Reviewed Paper Physics, Tappi Journal, Aug. 2006 (7 pages).

Levy, A.W., "Archived—CBD-192. Interior Lighting Design and Energy Conservation," Canadian Building Digests, NRC-IRC Publications, http://archive.nrc-cnrc.gc.ca/eng/ibp/irc/building-digest-192.html, last visited on Nov. 27, 2012 (4 pages).

* cited by examiner

ADJUSTABLE ILLUMINATION DEVICE PROVIDING POLARIZED LIGHT HAVING AN INDICATION MEANS FOR PROVIDING ADJUSTMENT

CROSS-REFERENCE TO PRIOR APPLICATIONS

This application is the U.S. National Phase application under 35 U.S.C. §371 of International Application No. PCT/EP2014/059289, filed on May 7, 2014, which claims the benefit European Patent Application No. 13166755.2, filed on May 7, 2013. These applications are hereby incorporated by reference herein.

FIELD OF THE INVENTION

The present invention relates to illumination devices. Specifically, the present invention relates to an illumination device capable of providing polarized light having a selected direction of polarization and having an indicator providing guidance for a user how to adjust the direction of polarization of light illuminating a surface. The present invention also relates to a method of adjusting the extent of light reflection from an illuminated surface.

BACKGROUND OF THE INVENTION

Light reflections from reflective surfaces, such as for example glossy paper, electronic tablets, or wet road surfaces, may be disturbing and glaring for an observer such as a reader of a text or a driver of a vehicle.

In for example U.S. Pat. No. 3,566,099, this issue is addressed by providing a light projection assembly having a polarizer arranged over the mouth of a parabolic reflector such that light passing through the polarizer is linearly polarized.

The amount of light that is reflected towards the eye of the observer may e.g. depend on the direction of polarization of the incident light, and the plane of incidence. The plane of incidence can be defined by a gaze point of the observer viewing the surface, a position of the light source and the at least partially reflective surface. By illuminating a reflective surface with light having a direction of polarization parallel to the plane of incidence, especially at an angle of incidence close to the Brewster angle, the extent of light reflection from the surface may be reduced.

There is however still a need for an improved illumination device enabling an improved control of the extent of light reflection from illuminated surfaces.

U.S. Pat. No. 2,402,176 discloses a device for the illumination of surfaces and is directed more particularly to the modification of light impinging on or reflected from surfaces in such manner as to eliminate or minimize glare when said surfaces are viewed by the human eye.

U.S. Pat. No. 5,161,879 discloses a flashlight for security personnel which has a gravity actuated switch for application of electrical power to multiple lamps to enable the projection of light in downward directions to illuminate multicolored working surfaces and to inhibit the projection of light in horizontal and other directions where hostile persons may be watching. The projected light intensity is variable by polarizing optical means and is coordinated with the gravity switch and the user's control so that the initial intensity at turn-on of the flashlight occurs at the lowest projected intensity.

US2002/0113560 discloses a lighting apparatus having a linearly polarizing lens. The polarizing lens is rotatable to any position in between a first position and a second position. By rotating the polarizing lens, different planes of polarization can be achieved. A user can also choose to vary the amount of rejection of surface reflectance by selectively adjusting the polarizers intermediate their first and second predetermined positions.

SUMMARY OF THE INVENTION

In view of the above, an object of at least some of the embodiments of the present invention is to enable improved control of the extent of light reflection from illuminated surfaces.

Accordingly, an illumination device and a method having the features of the independent claims are provided. The dependent claims define advantageous embodiments.

According to a first aspect of the invention, an illumination device for illuminating an at least partially reflective surface, viewable by an observer, is provided. The illumination device comprises a light-emitting module adapted to generate polarized light having a selected direction of polarization. The illumination device is adapted to illuminate the at least partially reflective surface with the polarized light and is adjustable so as to effect adjustment in the direction of polarization of light illuminating the at least partially reflective surface in relation to the orientation of a plane of incidence of light incident on the at least partially reflective surface. Furthermore, the illumination device comprises an indicator which may be adapted to indicate the direction of polarization of the polarized light to the observer. The indicator is arranged such as to provide guidance for the observer how to adjust the direction of polarization of light illuminating the at least partially reflective surface so as to comply with a selected criterion for extent of light reflection from the at least partially reflective surface.

According to a second aspect, a method for facilitating for an observer to adjust the extent of light reflection from an at least partially reflective surface viewable by the observer is provided. The at least partially reflective surface is illuminated by an illumination device comprising a light-emitting module adapted to generate polarized light having a selected direction of polarization. The illumination device is adapted to illuminate the at least partially reflective surface with the polarized light, and the illumination device is adjustable so as to effect adjustment of the direction of polarization of light illuminating the at least partially reflective surface in relation to the orientation of a plane of incidence of light incident on the at least partially reflective surface. The method comprises providing an indicator adapted to indicate the direction of polarization of the polarized light to the observer, and arranging the indicator such as to provide guidance for the observer how to adjust the direction of polarization of light illuminating the at least partially reflective surface so as to comply with a selected criterion for extent of light reflection from the at least partially reflective surface.

Several advantages are associated with the present aspects. For example, the indicator allows the observer to adjust the direction of polarization such that the extent of light reflection, or glare, from the illuminated at least partially reflective surface may comply with a selected criterion. The criterion may for example be a reduction of reflections to a predefined or selected extent as compared with illumination by unpolarized light, which advantageously may reduce disturbing glare from information carriers such as glossy magazines and electronic tablets, and hence improve the readability of the text. By the observer being able to reduce undesired glare from such surfaces, it may be possible for e.g. publishers and manufacturers of flat screen products to use glossy paper and displays, respectively, having a glossy finish. Surfaces having glossy finish are sometimes regarded to provide an improved image quality as compared with surfaces having a matte finish. Further, being able to adjust the direction of polarization of the light impinging on an object may also allow for the amount of reflected light to be increased as compared with illumination using unpolarized light. This may be advantageous for illumination of crystals, jewels, diamonds, and other objects where a sparkling effect may be desired. Reflections may also be desired at glossy surfaces for design purposes. For such cases, the indicator can provide guidance for the observer, or user or installer, to adjust the direction of polarization of the light so as to intensify the reflections at the illuminated surfaces of the object. The present aspects may also provide a relatively flexible illumination device and a method which can be adapted to various illumination conditions and requirements. As previously mentioned, the same device may be used both for providing enhanced sparkling effects in crystals as perceived by the viewer or observer, as well as comfortable illumination for the user for reading a glossy magazine.

The present aspects are based on a realization that by providing guidance for an observer how to adjust the direction of polarization of light illuminating the surface being viewed by the observer, the amount of reflections reaching the eye of the observer may be controlled so as to comply with a desired criterion. This is achieved by using the effect that the fraction of incident light that is reflected depends, inter alia, on the direction of polarization of the incident light, which thereby provides the possibility of controlling the extent of light reflection at or from the surface.

The plane of incidence may be defined by a gaze point of the observer viewing the surface, a position of the light-emitting module and the at least partially reflective surface. Additionally, or alternatively, the plane of incidence may be defined by the propagation vector of the incident light and the normal to the at least partially reflective surface.

The light-emitting module may e.g. comprise a light source being adapted to emit unpolarized light, and a polarizer arranged to receive the emitted light and to generate polarized light having a desired direction of polarization. Additionally, or alternatively, the light-emitting module may e.g. comprise a light source emitting polarized light having a selected direction of polarization.

In the context of the present application, the term "light source" is used to define substantially any device or element that is capable of emitting radiation in any region or combination of regions of the electromagnetic spectrum, for example the visible region, the infrared region, and/or the ultraviolet region, when activated e.g. by applying a potential difference across it or passing a current through it. Therefore a light source can have monochromatic, quasi-monochromatic, polychromatic or broadband spectral emission characteristics. Examples of light sources include semiconductor light-emitting diodes (LEDs) or lasers, organic, or polymer/polymeric light-emitting diodes (such as OLEDs), RGB LEDs, optically pumped phosphor coated LEDs, optically pumped nano-crystal LEDs, RGB laser combinations, white broadband lasers, laser pumped phosphors, or any other similar devices as known to a person skilled in the art.

According to an embodiment, the indicator is arranged such as to provide guidance for the observer how to adjust the direction of polarization of light illuminating the at least partially reflective surface so as to illuminate the at least partially reflective surface with s-polarized light or with p-polarized light. s-polarized light, i.e. light having a polarization direction being orthogonal to the plane of incidence, advantageously enables the extent of reflections to be increased as compared with illumination using unpolarized light, while p-polarized light, i.e. light having a polarization direction being parallel to the plane of incidence, advantageously enables the extent of reflection at the illuminated surface to be reduced as compared with illumination using unpolarized light. The adjustment by the observer may be enabled by an indicator which e.g. may indicate the polarization direction of the light passing through the polarizer. Alternatively, or additionally, the indicator may indicate an orientation of the illumination device (or the light-emitting module or the polarizer), which orientation e.g. corresponds to an increased or reduced extent of reflection at the illuminated surface. Thereby the adjustment may be performed by a user or the observer with relative ease, possibly only requiring relatively little knowledge or even no knowledge at all of the relation between the direction of polarization and the extent of light reflection at the illuminated surface.

An indicator should in the context of the present application be understood as any means arranged for indicating, e.g. to the user, a desired illumination that needs to be achieved, e.g. defined by a selected criterion for extent of light reflection from the at least partially reflective surface. The indicator may thus be understood as any means for indicating indirectly and/or directly a direction of polarization of light exiting the illumination device. The indicator may be realized by pointer or a marking, such as an arrow, text, symbol, or picture, and may indicate the direction of the polarization of the exiting light, or the required direction (or orientation) of the illumination device (or the light-emitting or the polarizer) at which a desired illumination may be achieved. The desired illumination may e.g. be defined by the selected criterion for extent of light reflection from the at least partially reflective surface. In alternative or in addition, the indicator may be auditory or tactile, or any combination of visual, auditory and tactile.

According to an embodiment, the illumination device comprises an angle indicator, such as e.g. an angle meter, which is arranged to provide guidance for the observer how to adjust the angle of incidence of light illuminating the at least partially reflective surface. The angle of incidence may be defined by the position of the light-emitting module, the position of the at least partially reflective surface, and the gaze point of the observer, and may be measured as the angle between the propagation vector of the incident light and the normal of the at least partially reflective surface at the point of incidence. By being able to adjust the angle of incidence, the amount of reflected light may be adjusted accordingly so as to comply with a selected criterion for extent of light reflection from the at least partially reflective surface. Relatively high angles of incidence may for example provide relatively large amount of reflected light, whereas an angle of incidence being close or equal to the Brewster angle of the surface at the point of incidence may result in a very low amount of reflected light having a polarization direction being parallel to the plane of incidence. The angle indicator may e.g. comprise a user interface instructing or indicating to the observer how to adjust the angle of incidence so as to comply with a selected criterion for extent of light reflection from the at least partially reflective surface. The user interface may be visual, auditory, or tactile, or any combination of visual, auditory and tactile. The present embodiment is advantageous in that it provides the possibility for an observer to adjust the illumination device so as to control the amount of reflected light, or the reflectance, at the point of incidence.

According to an embodiment, the illumination device comprises a distance indicator, such as e.g. a distance meter, being arranged such as to prove guidance for the observer how to adjust a first distance between the light-emitting module and the gaze point of the observer, and a second distance between the at least partially reflective surface and the gaze point of the observer. By adjusting the first and second distance and possibly also the angle there between, the angle of incidence may be adjusted so as to comply with a selected criterion for extent of light reflection from the at least partially reflective surface. Being able to adjust the distance between the viewable object and the gaze point of the observer by guidance of the distance indicator may also provide the possibility to achieve a comfortable experience for the observer, such as e.g. a reading experience for a reader.

The direction between the light-emitting module and the gaze point of the observer may be defined by a first vector and the direction between the at least partially reflective surface and the gaze point of the observer by a second vector. The first and second vectors may e.g. be orthogonal, which advantageously provides the possibility to achieve a desired angle of incidence by using the distance indicator.

According to an embodiment, the light-emitting module comprises a reflective-transmissive polarizer being adapted to transmit a first component of light having the selected direction of polarization, and to reflect another component of light having another direction of polarization back towards the light source. The polarizer may for example be configured such as the polarizers disclosed in EP0606940 B1 or EP0606939 B1. By reflecting at least some of the light that is not transmitted through the reflective-transmissive polarizer back towards the light source, the reflected light may be 'recycled' so as to provide an increased optical efficiency of the illumination device. The reflected light may e.g. be recycled by providing a reflector being arranged to redirect the reflected light back towards the reflective-transmissive polarizer. Since the polarization of the reflected light may be changed upon reflection, at least some of the recycled light may eventually be transmitted through the reflective-transmissive polarizer.

According to an embodiment, the reflective-transmissive polarizer is adapted so as to transmit and reflect light, respectively, having a first polarization state. By arranging a polarizing state converter such that it receives at least some of the light reflected by the reflective-transmissive polarizer, the polarizing state converter may convert light having the first polarization state into light having a second polarization state. The converted light may then be recycled by e.g. a reflector being arranged to redirect the converted light back towards the polarization state converter wherein the recycled light is converted back to the first state.

The first polarizing state may e.g. be a linear polarization, which after reflection at the reflective-transmissive polarizer may be converted into a circular polarization by the polarizing state converter. Since circularly polarized light may change polarization direction, i.e. from right handed polarization to left handed polarization or vice versa upon reflection in the reflector, the amount of recycled light having the selected polarization direction may be increased.

According to an embodiment, the reflective-transmissive polarizer is adapted so as to transmit and reflect light, respectively, having a first polarization state, and the illumination device further comprising a polarizing state converter being arranged relatively to the reflective-transmissive polarizer so as to receive at least some of the light transmitted by the reflective-transmissive polarizer. The polarizing state converter may be adapted to convert light having the first polarization state into light having a second polarization state. According to this embodiment, the reflective-transmissive polarizer may e.g. be a circular polarizer adapted to transmit circularly polarized light having the selected direction of polarization, and to reflect circularly polarized light having another direction of polarization. Reflecting light having an undesired direction of polarization advantageously allows for the reflected light to be recycled and converted into light having the selected direction of polarization. In case the reflective-transmissive polarizer is a circular polarizer, the polarizing state converter advantageously comprises a wave plate or retarder, e.g. a quarter-wave plate adapted to convert circularly polarized light into linearly polarized light.

According to an embodiment, the polarizing state converter comprises a quarter-wave plate, or film, comprising a stack of birefringent layers so as to enable a phase shift between polarization components for light comprising several different wave lengths. Thereby, any ellipticity of the polarized light exiting the polarizing state converter may be reduced or even eliminated.

Additionally, or alternatively, the polarizing state converter may comprise a twisted liquid crystalline structure, e.g. a 90° twisted nematic liquid crystalline structure, which may include a liquid crystalline layer sandwiched between two transparent substrates, or a polymerized liquid crystalline material.

It will be appreciated that the illumination device may be included in e.g. an office luminaire adapted to illuminate a working area, such as a writing desk, a desk lamp, or a floor standing reading lamp. The light-emitting module (and/or polarizer) may e.g. be circular or quadratic shaped, and may be adjustable between two positions, e.g. a first position providing light having a direction of polarization being parallel to the plane of incidence and a second position providing light having a direction of polarization being orthogonal to said plane. Making the observer choose between a relatively small number of adjustment options, such as e.g. two options, advantageously allows for a facilitated adjustment with a reduced risk for incorrect adjustment being made by the user or observer. The light-emitting module (and/or polarizer) may also be arranged so as to assume any desired position, thereby providing a possibility for the observer to adjust and tune the direction of polarization to any required direction.

Additionally, or alternatively, the illumination device may comprise a plurality of reflectors having at least one respective light source arranged to emit light into each respective reflector. Using a plurality of reflectors advantageously may allow for an illumination device having a reduced thickness. The illumination device may also comprise a plurality of light-emitting modules, e.g. comprising one polarizer for each reflector, which may be individually adjustable.

It is noted that the invention relates to all possible combinations of features recited in the claims.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, in which.

All the figures are schematic, not necessarily to scale, and generally only show parts which are necessary in order to elucidate the embodiments of the present invention, wherein other parts may be omitted or merely suggested Like reference numerals refer to like elements throughout.

DETAILED DESCRIPTION

The present invention will now be described more fully hereinafter with reference to the accompanying drawings illustrating embodiments of the present invention, wherein the light-emitting module comprises a light source adapted to emit unpolarized light which can be received by a polarizer, and wherein the polarizer is arranged to generate polarized light having a selected direction of polarization. This invention may, however, be embodied in many different forms and should not be construed as limited to the embodiments set forth herein; rather, these embodiments are provided for thoroughness and completeness, and to convey the scope of the invention to the skilled person. For example, it will be appreciated that the light-emitting module may comprise a light source being adapted to emit polarized light having a selected direction of polarization, and optionally a polarizer which e.g. may be integrally formed with the light source, or movably arranged at a light-exiting portion of a reflector of the illumination device.

Figure 1:
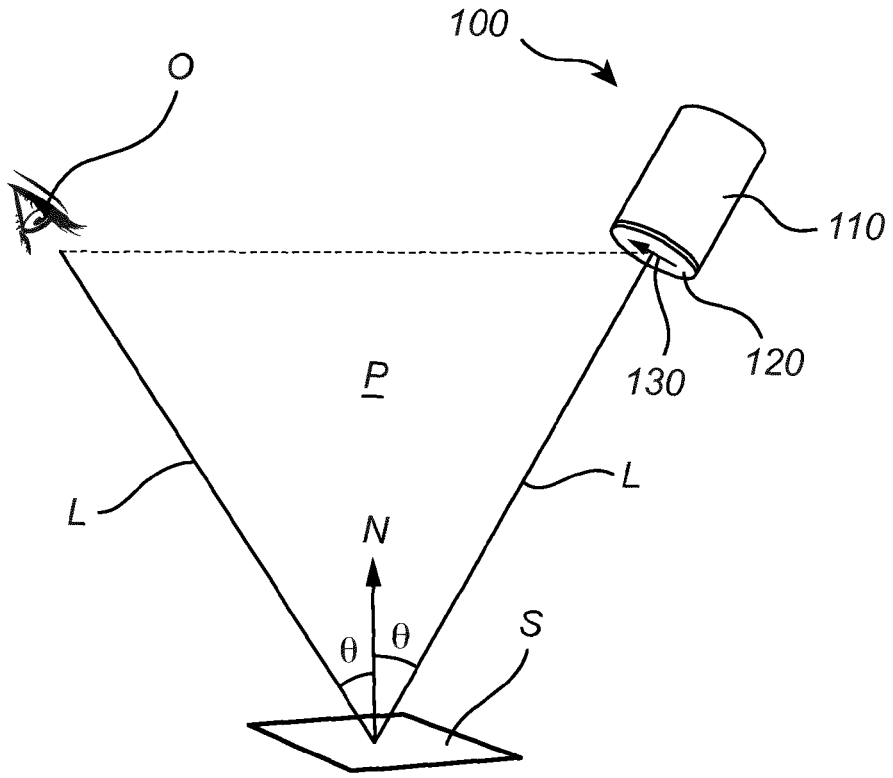
FIG. 1 schematically illustrates an illumination device according to an embodiment of the present invention.

With reference to FIG. 1, there is schematically depicted an illumination device 100 according to an embodiment of the present invention. The illumination device 100 comprises a light source 110 and a polarizer 120 forming a light-emitting module. The polarizer 120 is arranged to receive light emitted by the light source 110 and generate polarized light having a selected direction of polarization.

The illumination device 100 is arranged such that polarized light exiting the polarizer 120 impinges on a surface S, which is at least partially light reflecting. The surface S, being viewable by an observer O, is according to the present embodiment realized by a piece of paper (e.g. a page of a magazine) having a glossy finish. The path of the light, being represented by the lines L in FIG. 1, extends in a plane of incidence P which is defined by the gaze point of the observer O, the point of incidence of the surface S, and the position of the polarizer 120 (or by a point on the polarizer 120 from which the light L is emitted).

The illumination device 100 is adjustable so as to effect adjustment in the direction of polarization of light illuminating the at least partially reflective surface in relation to the orientation of a plane of incidence of light incident on the surface S. To this end, the polarizer 120 may be adjustable so as to effect adjustment in the direction of polarization of light illuminating the at least partially reflective surface S in relation to the orientation of a plane of incidence of light incident on the surface S. According to the embodiment depicted in FIG. 1, this is achieved by means of the polarizer 120 being rotatable, e.g. by an observer O, such that the direction of polarization of the emitted light is rotated accordingly.

The illumination device 100 comprises an indicator 130 in the form of an arrow 130. The indicator 130 may in some embodiments of the present invention be arranged so as to indicate to the observer O the desired direction of the polarization of the light emitted by the illumination device 100.

According to the present embodiment as depicted in FIG. 1, the arrow 130 is arranged so as to provide guidance for the observer O on how to adjust the direction of polarization of light illuminating the surface S such that the extent of light reflection at the surface S is reduced. The arrow 130 is provided on the adjustable polarizer 120 which can be rotated by the observer O, such that the direction of polarization of the emitted light is rotated accordingly. By adjusting the polarizer 120 such that the arrow 130 is pointing towards the observer O, the light emitted from the polarizer 120 becomes p-polarized, i.e. such that it has a direction of polarization being parallel with the plane of incidence P, which thereby enables a further reduction of the amount or extent of reflected light from the surface S. Additionally, or alternatively, the extent of light reflection at the surface S may be adjusted by varying the angle of incidence θ at the surface S, which may be defined by the angle between the direction of the incident light and the normal N to the surface S. The angle of incidence θ may e.g. be adjusted by moving the illumination device 100 to another position, or by moving the illuminated surface S. In one example, the arrow 130 is directed such that the direction of polarization is parallel to the plane of incidence P and the angle of incidence θ is adjusted such that it is equal to, or at least close to, the Brewster angle for the surface S, at which Brewster angle a minimum of reflectance has been observed.

Furthermore, the arrow 130, or any other indicator, may be used to facilitate adjustment of the direction of polarization of the light so as to increase the extent of light reflection at the illuminated surface S. According to the embodiment depicted in FIG. 1, this may be achieved by rotating the polarizer by 90°, or about 90°, as compared with the orientation where the arrow 130 is pointing towards the observer O. Thereby light having a direction of polarization that is orthogonal to the plane of incidence P, or s-polarized light, is provided which allows for a relatively high extent of reflection of light at the surface S.

Figure 2:
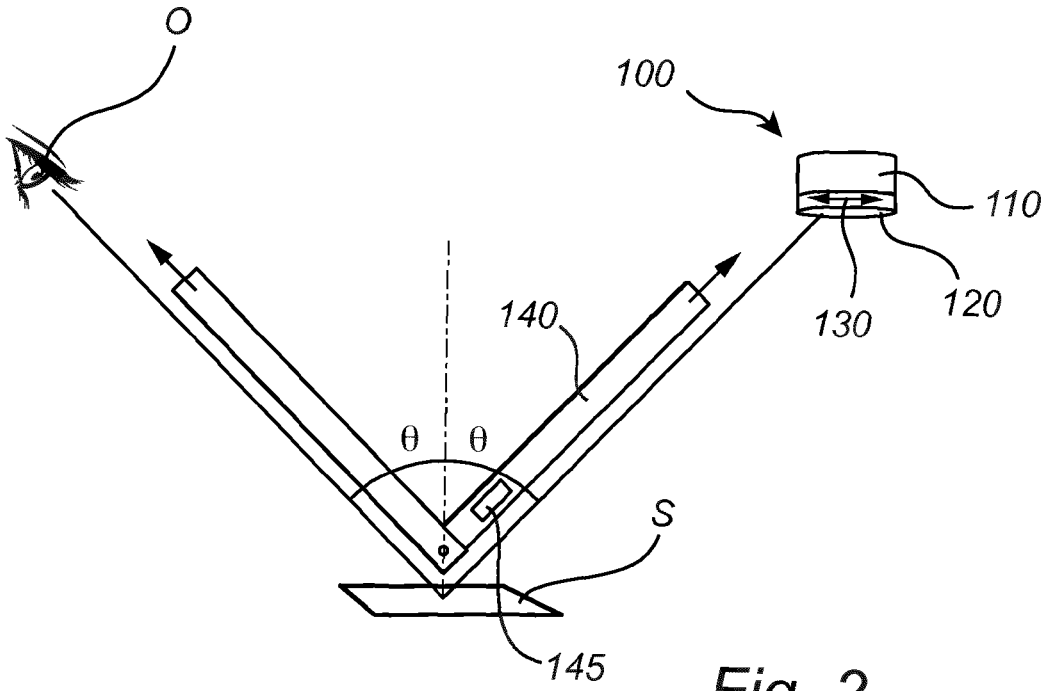
FIGS. 2 and 3 illustrate illumination devices according to embodiments of the present invention.

FIG. 2 depicts an illumination device 100 according to another embodiment of the present invention, which illumination device 100 is similar to the illumination device 100 as described with reference to FIG. 1. The illumination device 100 comprises a light source 110, a polarizer 120 and an indicator 130. According to the embodiment depicted in FIG. 2, the polarizer 120 is adjustable so as to effect adjustment in the direction of polarization of light illuminating an at least partially reflective surface S in relation to the orientation of a plane of incidence of light incident on the surface S. The indicator 130 indicates to an observer O the direction of the polarization of the light emitted by the illumination device 100. The light source 110, polarizer 120 and indicator 130 may be the similar or the same as the light source 110, polarizer 120 and indicator 130, respectively, of the illumination device 100 described with reference to FIG.

1. The illumination device 100 depicted in FIG. 2 comprises an angle indicator in the form of an angle meter 140 arranged so as to provide guidance for the observer O how to adjust the angle of incidence θ of light emitted by the light source 110 of the illumination device 100 incident on the surface S. The angle of incidence θ may be defined by a position of the polarizer 120, e.g. a point on the polarizer 120 from which the light L is emitted, the position of the surface S, and a gaze point of the observer O. By adjusting the angle of incidence θ the extent of light reflection from the surface S may be adjusted so as to comply with a selected criterion, e.g. providing a reduction of light reflection from the surface S in order to reduce glare. The angle meter 140, such as e.g. a protractor 140, may for example be provided with an indicator such as a display 145 or the like adapted to instruct the observer O on how to adjust the position and/or orientation of the illumination device 100 and/or the position of the surface S. The display 145 may e.g. assume a red color if the angle of incidence is too large or too small, or display a message, e.g. a text message, indicating to the observer O to adjust the illumination device 100, e.g. so as to move the illumination device 100 in a certain direction, so as to achieve a desired adjustment of the angle of incidence θ (and thereby a desired adjustment of the extent of light reflection from the surface S).

Figure 3:
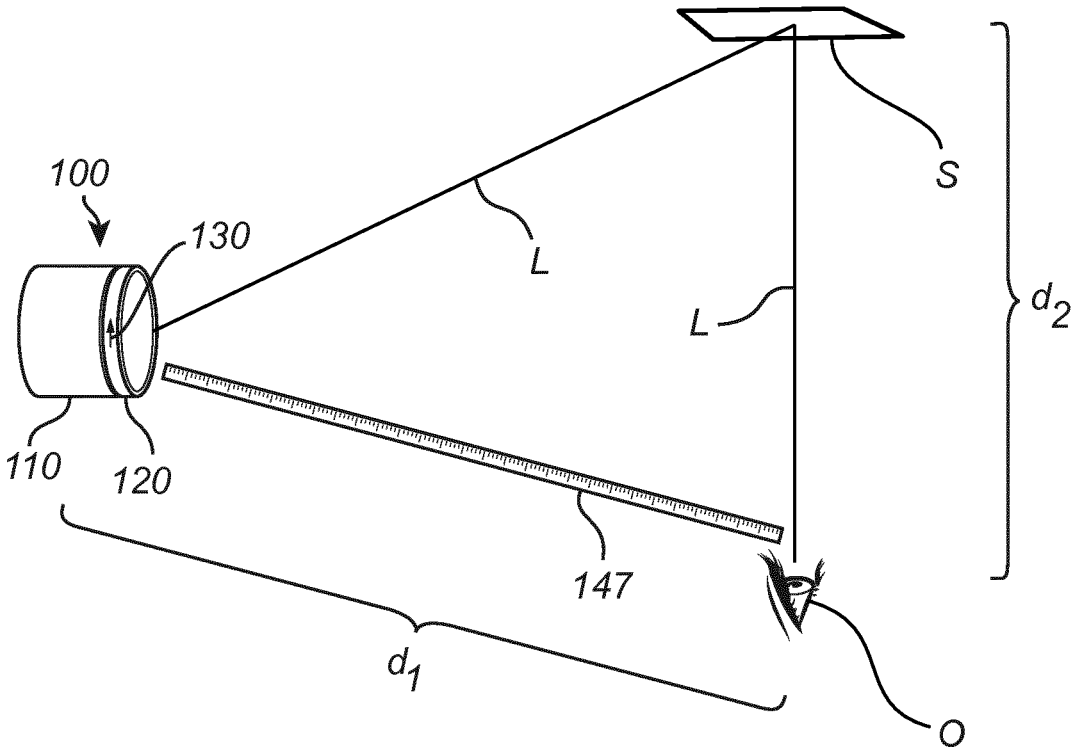

FIG. 3 illustrates an illumination device 100 according to another embodiment of the present invention. The illumination device 100 comprises a light source 110 and an adjustable polarizer 120, which is adjustable so as to effect adjustment in the direction of polarization of light illuminating an at least partially reflective surface S in relation to the orientation of a plane of incidence of light incident on the surface S. The polarizer 120 is provided with an indicator 130. The indicator 130 provides the observer O, viewing the illuminated surface S, with guidance on how to adjust the direction of polarization of the incident light on the surface S so as to reduce or increase the reflections at the surface S. The illumination device 100 further comprises a distance indicator 147, e.g. including a distance meter such as e.g. a measuring tape or a ruler, which is adapted to provide guidance for the observer O how to adjust a first distance $d_1$ between the polarizer 120 and a gaze point of the observer O, and a second distance $d_2$ between the illuminated surface S and the gaze point of the observer O. By adjusting the first distance $d_1$ and/or the second distance $d_2$ the angle of incidence of light emitted by the illumination device 100 incident on the surface S may be adjusted so as to comply with a selected criterion for extent of light reflection from the surface S, e.g. by providing a reduction of light reflection from the surface S in order to reduce glare.

Figure 4A:
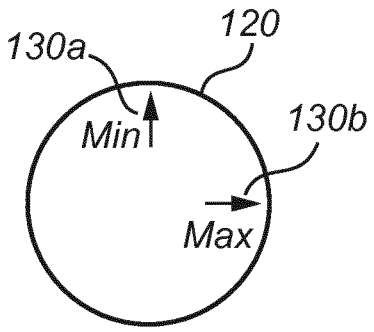
FIGS. 4*a* and 4*b* are top views of polarizers according to embodiments of the present invention.
Figure 4B:
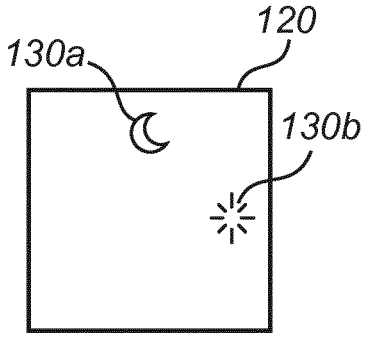

FIGS. 4*a* and 4*b* show respective polarizers 120 in accordance with different embodiments of the present invention. The polarizers 120 depicted in FIGS. 4*a* and 4*b*, respectively, may be used in conjunction with any of the embodiments of the present invention described herein, e.g. any one of the embodiments of the present invention described above with reference to FIGS. 1-3.

FIG. 4*a* illustrates a polarizer 120 having the shape of a circular disc having two indicators 130*a*, 130*b* in the form of arrows. The first arrow 130*a* indicates a reduction of light reflection, while the second arrow 130*b* indicates an increase of light reflection. For example with reference to any one of the embodiments of the present invention described above with reference to FIGS. 1-3, control of the extent of light reflection at the surface S may be achieved by the observer O adjusting the polarizer 120 such that either the first arrow 130*a* is pointing towards the observer O or such that the second arrow 130*b* is pointing towards the observer O. Adjusting the polarizer 120 such that the first arrow 130*a* points towards the observer O may for example correspond to the polarizer 120 being oriented such that the direction of polarization of the light L exiting the illumination device 100 is parallel to the plane of incidence P. Thereby the extent of light reflection at the illuminated surface S may be reduced, especially at angles of incidence θ close to the Brewster angle. By instead adjusting the polarizer 120 such that the second arrow 130*b* is directed or is pointing towards the observer O, the polarizer 120 may be oriented such that light having a direction of polarization parallel to the plane of incidence is generated, which advantageously may increase the extent of light reflection at the illuminated surface S—especially at angles of incidence θ close to the Brewster angle.

FIG. 4*b* illustrates a polarizer 120 similar to the polarizer in FIG. 4*a*, having a rectangular shape and wherein the indicators 130*a*, 130*b* represent a moon 130*a* (indicating reduction of light reflection) and a star 130*b* (indicating an increase of light reflection or sparkling effect).

It will be appreciated that the indicator(s) 130 may be represented by any suitable symbol, shape, or figure or the like instructing or indicating to the observer O how to adjust the direction of polarization. The direction of polarization may be adjusted e.g. by rotating the polarizer 120 in relation to the light source 110, or, in case the polarizer 120 is fixated to the light source 110, by rotating or adjusting the light source 110. The indicator(s) 130 may e.g. be provided on a light outcoupling portion and/or on a side portion of the polarizer 120, or on the light source 110.

Figure 5:
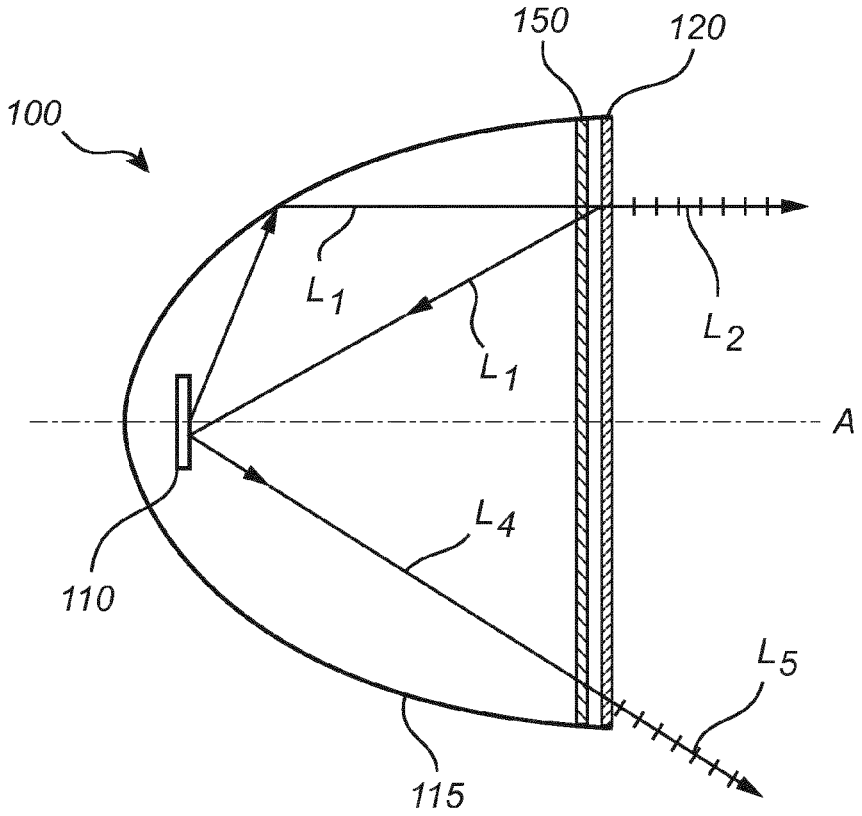
FIGS. 5 and 6 are cross-sectional side views of illumination devices according to embodiments of the present invention, comprising a polarizer and a polarizing state converter.

With reference to FIG. 5, there is shown a cross sectional side view of an illumination device 100 according to an embodiment of the present invention. The illumination device 100 comprises a substantially parabolic or parabolic reflector 115 within which a light source 110 is arranged to emit light. The light source 110 may, according to the present embodiment, be arranged such that it is intersected by an optical axis A of the reflector 115. Further, the illumination device 100 comprises a polarizing state converter 150, such as e.g. a quarter-wave plate 150, arranged relatively to the reflector 115 so as to receive at least some of the light $L_1$ emitted by the light source 110 and possibly reflected at the reflector 115, and a polarizer 120, such as e.g. a reflective-transmissive linear polarizer 120, arranged relatively to the polarizing state converter 150 so as to receive at least some of the light transmitted by the polarizing state converter 150. The polarizer 120 is adapted to transmit light $L_2$ having a selected polarization direction, such as e.g. linearly polarized light having a direction of polarization parallel to the plane of incidence P, and to reflect light having another polarization direction, such as e.g. linearly polarized light having a direction polarization orthogonal to the plane of incidence P, i.e. s-polarized light. The quarter-wave plate 150 may further be arranged to receive the reflected, s-polarized light and convert at least some of the light into circularly polarized light $L_3$ which is transmitted back into the reflector 115. Every time the circularly polarized light $L_3$ is reflected within the reflector 115, e.g. on an inner surface of the reflector 115 and/or on a reflective portion of the light source 110, the direction of polarization is changed such that e.g. right handed polarized light is converted into left handed polarized light and vice versa. Therefore, according to the embodiment depicted in FIG. 5 at least some of the light $L_4$ that has been reflected once on the light source 110 (i.e. an odd number of times) may, as it eventually impinges on the quarter-wave plate 150, be converted by the quarter-wave plate 150 into linearly polarized light $L_5$ having the selected direction of polarization, and may thus be transmitted through the polarizer 120. The direction of polarization of light emitted by the illumination device 100, e.g. in relation to the orientation of a plane of incidence of light incident on the surface S (not shown) may e.g. be adjusted by rotating the polarizer 120 about the optical axis A. The adjustment may in alternative or optionally be realized by a rotation of the entire illumination device 100 about the optical axis A. Furthermore, the illumination device 100 may comprise an indicator (not shown) as previously described with reference to FIGS. 1-4, which indicates to the observer the direction of the polarization of the light emitted by the illumination device 100. The indicator may be arranged so as to provide guidance for the observer O on how to rotate the polarizer 120 and/or illumination device 100 such that the extent of light reflection at the surface S is reduced.

Figure 6:
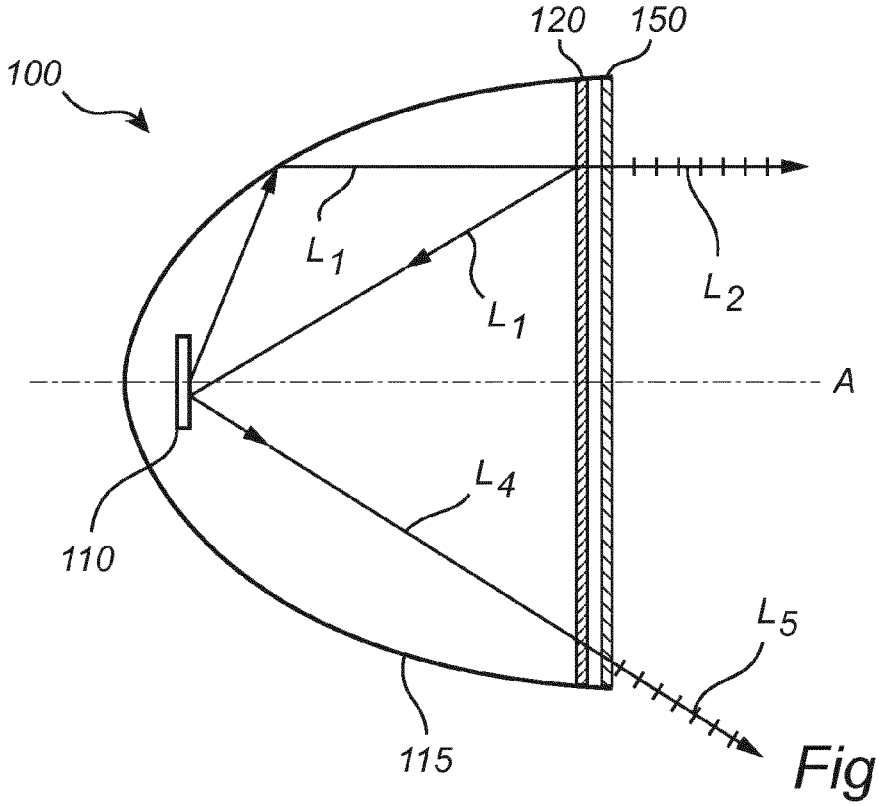

FIG. 6 depicts an illumination device 100 according to another embodiment of the present invention. The illumination device 100 depicted in FIG. 6 is similar to the illumination device 100 described with reference to FIG. 5. Compared to the illumination device 100 described with reference to FIG. 5, the polarizer 120 in the illumination device 100 depicted in FIG. 6 is a reflective-transmissive circular polarizer 120, arranged to transmit circularly polarized light having a selected direction of polarization, such as e.g. right-handed polarization and to reflect circularly polarized light having another direction of polarization, such as e.g. left-handed polarization. Further, according to the embodiment depicted in FIG. 6 the polarizing state converter 150, which e.g. may be a quarter-wave plate, may be arranged relatively to the polarizer 120 so as to receive at least some of the transmitted light and to convert at least some of the transmitted light $L_5$ into linearly polarized light.

Figure 7:
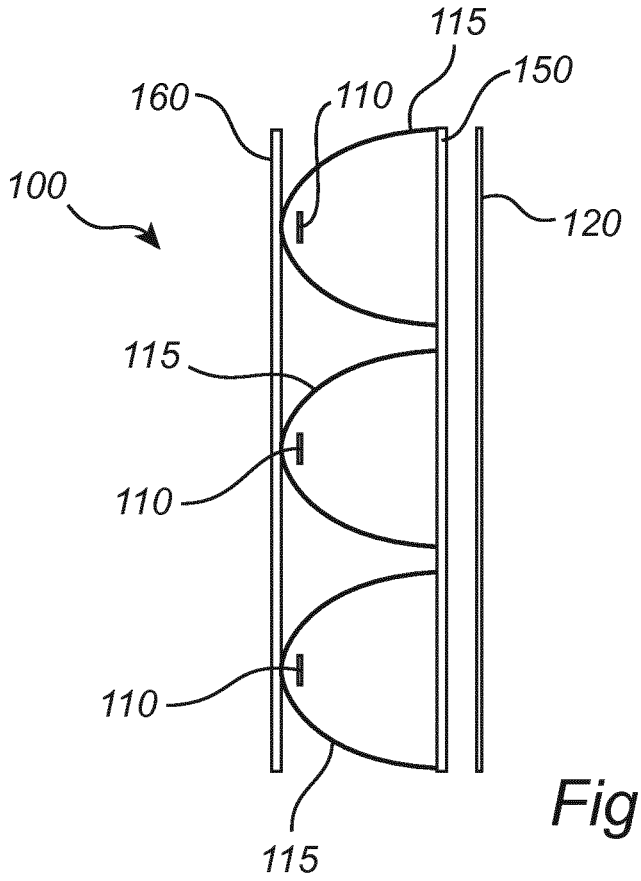
FIG. 7 is a cross-sectional side view of an illumination device according to an embodiment of the present invention, comprising a plurality of reflectors and light sources, and FIG. 8 schematically illustrates a floor standing reading light comprising an illumination device according to an embodiment of the present invention.

FIG. 7 is a cross sectional side view of an illumination device 100 according to another embodiment of the present invention. The illumination device 100 comprises a plurality of reflectors 115 which may be arranged on a common substrate 160, e.g. comprising a printed circuit board (PCB) 160. However, it is possible to arrange each reflector 115 on a separate substrate, or subsets of reflectors 115 on separate substrates (e.g. PCBs). The reflectors 115 may for example comprise or be parabolic reflectors. Within each reflector 115 there is provided a respective or corresponding light source 110 being arranged so as to emit light towards a polarizing state converter 150 and a polarizer 120, such as e.g. a reflective-transmissive linear polarizer 120, similar to or the same as the polarizing state converter 150 and the polarizer 120 in the illumination device 100 described above with reference to FIG. 5. The polarizing state converter 150 and the polarizer 120 may form a unit which is adjustable, e.g. rotatable, in relation to the plurality of reflectors 115 and the plurality of light sources 110 so as to enable the direction of polarization of the generated polarized light emitted by the illumination device 100 to be adjusted. The illumination device 100 is adapted to illuminate an at least partially reflective surface (not shown in FIG. 7) viewable by an observer (not shown in FIG. 7) with the polarized light. Furthermore, the polarizer 120 and/or the polarizing state converter 150 may be provided with an indicator (not shown in FIG. 7) arranged to provide guidance for the observer how to adjust the direction of polarization so as to comply with a selected criterion for extent of light reflection from the at least partially reflective surface.

Figure 8:
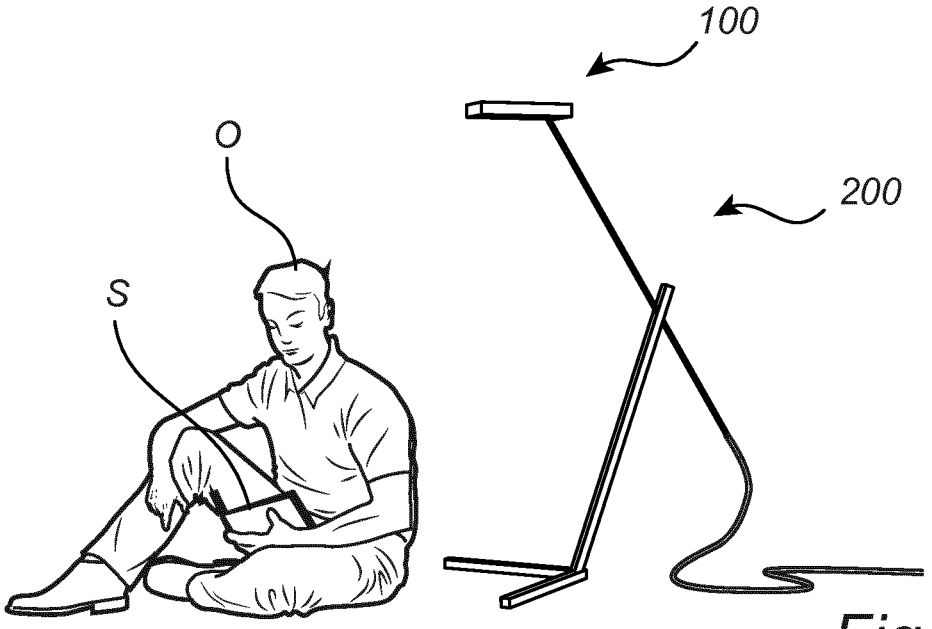

Finally, FIG. 8 depicts a luminaire 200 in the form of a floor standing reading light 200 comprising an illumination device 100 according to an embodiment of the present invention, for example according to an embodiment of the present invention as described with reference to any one of FIGS. 1 to 3 and 5 to 6. The illumination device 100 comprises an indicator (not shown in FIG. 8) arranged such as to provide guidance to an observer O, such as a reader O, how to adjust the direction of polarization of light illuminating an at least partially reflective surface S, such as a glossy surface S of a magazine, so as to reduce the extent of light reflection from the surface S.

The person skilled in the art realizes that the present invention by no means is limited to the preferred embodiments described above. On the contrary, many modifications and variations are possible within the scope of the appended claims. It will also be appreciated that by the term "observer" should in the context of the present application be understood not only a person viewing the at least partially light reflecting surface S, but also e.g. an installer, a user, or a repairer.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. An illumination device for illuminating an at least partially reflective surface viewable by an observer, the illumination device comprising:

a light-emitting module adapted to generate polarized light having a selected direction of polarization;

wherein the illumination device is adapted to illuminate the at least partially reflective surface with the polarized light; and wherein the illumination device is adjustable so as to effect adjustment in the direction of polarization of light illuminating the at least partially reflective surface in relation to the orientation of a plane of incidence of light incident on the at least partially reflective surface;

the illumination device further comprising:

an indicator being arranged such as to provide guidance for the observer how to adjust the direction of polarization of light illuminating the at least partially reflective surface so as to comply with a selected criterion for extent of light reflection from the at least partially reflective surface, wherein the indicator is arranged on a portion of the illumination device.

2. The illumination device according to claim 1, wherein the indicator is arranged such as to provide guidance for the observer how to adjust the direction of polarization of light illuminating the at least partially reflective surface so as to illuminate at least partially reflective surface with s-polarized light or p-polarized light.

3. The illumination device according to claim 1, further comprising an angle indicator being arranged such as to provide guidance for the observer how to adjust the angle of incidence defined by a position of the light-emitting module, the position of the at least partially reflective surface and a gaze point of the observer so as to comply with the selected criterion for extent of light reflection from the at least partially reflective surface.

4. The illumination device according to claim 1, further comprising a distance indicator being arranged such as to provide guidance for the observer how to adjust a first distance between the light-emitting module and a gaze point of the observer and a second distance between the at least partially reflective surface and the gaze point of the observer so as to comply with the selected criterion for extent of light reflection from the at least partially reflective surface.

5. The illumination device according to claim 4, wherein a first vector, defining the direction between the light-emitting module and the gaze point of the observer is orthogonal to a second vector defining the direction between the at least partially reflective surface and the gaze point of the observer.

6. The illumination device according to claim 1, wherein the light-emitting module comprises a reflective-transmissive polarizer adapted to transmit a first component of light having the selected direction of polarization and to reflect another component of light having another direction of polarization back towards the light source.

7. The illumination device according to claim 6, wherein the reflective-transmissive polarizer is adapted so as to transmit and reflect light, respectively, having a first polarization state, the illumination device further comprising:

a polarizing state converter being arranged relatively to the reflective-transmissive polarizer so as to receive at least some of the light reflected by the reflective-transmissive polarizer and to convert light having the first polarization state into light having a second polarization state.

8. The illumination device according to claim 7, wherein the polarizing state converter comprises a plurality of stacked birefringent layers.

9. The illumination device according to claim 7, wherein the polarizing state converter comprises a twisted liquid crystalline structure.

10. The illumination device according to claim 6, wherein the reflective-transmissive polarizer is adapted so as to transmit and reflect, respectively, light having a first polarization state, the illumination device further comprising:

a polarizing state converter being arranged relatively to the reflective-transmissive polarizer so as to receive at least some of the light transmitted by the reflective-transmissive polarizer and to convert light having the first polarization state into light having a second polarization state.

11. The illumination device according to claim 1, further comprising a plurality of light sources.

12. A luminaire comprising an illumination device according to claim 1.

13. A method for facilitating for an observer to adjust the extent of light reflection from an at least partially reflective surface viewable by the observer, when the at least partially reflective surface is illuminated by an illumination device comprising a light-emitting module adapted to generate polarized light having a selected direction of polarization, wherein the illumination device is adapted to illuminate the at least partially reflective surface with the polarized light, and the illumination device is adjustable so as to effect adjustment in the direction of polarization of light illuminating the at least partially reflective surface in relation to the orientation of a plane of incidence of light incident on the at least partially reflective surface, the method comprising:

arranging an indicator such as to provide guidance for the observer how to adjust the direction of polarization of light illuminating the at least partially reflective surface so as to comply with a selected criterion for extent of light reflection from the at least partially reflective surface, wherein the indicator is arranged on a portion of the illumination device.

* * * * *